US011377247B2

(12) United States Patent
Uetsuki et al.

(10) Patent No.: US 11,377,247 B2
(45) Date of Patent: Jul. 5, 2022

(54) APPARATUS AND METHOD FOR HEAT TREATMENT OF HEAT SHRINKABLE FILM

(71) Applicant: FUJI SEAL INTERNATIONAL, INC., Osaka (JP)

(72) Inventors: Akira Uetsuki, Osaka (JP); Yasuyuki Kawauchi, Osaka (JP)

(73) Assignee: FUJI SEAL INTERNATIONAL, INC., Osaka (JP)

( * ) Notice: Subject to any disclaimer, the term of this patent is extended or adjusted under 35 U.S.C. 154(b) by 0 days.

(21) Appl. No.: 17/264,322

(22) PCT Filed: Aug. 1, 2019

(86) PCT No.: PCT/JP2019/030144
§ 371 (c)(1),
(2) Date: Jan. 29, 2021

(87) PCT Pub. No.: WO2020/031824
PCT Pub. Date: Feb. 13, 2020

(65) Prior Publication Data

US 2021/0292023 A1 Sep. 23, 2021

(30) Foreign Application Priority Data

Aug. 6, 2018 (JP) ..... JP2018-147918

(51) Int. Cl.
*B65B 53/06* (2006.01)
*B65C 3/16* (2006.01)

(52) U.S. Cl.
CPC ..... *B65B 53/063* (2013.01); *B65C 3/166* (2013.01)

(58) Field of Classification Search
CPC ..... B65B 53/02; B65B 53/06; B65B 53/063; B65C 3/166
See application file for complete search history.

(56) References Cited

U.S. PATENT DOCUMENTS 8,196,376 B2 6/2012 Uetsuki et al.
2010/0032077 A1 2/2010 Uetsuki et al.
(Continued)

FOREIGN PATENT DOCUMENTS

JP 09-272514 A 10/1997
JP 2001-048128 A 2/2001
(Continued)

OTHER PUBLICATIONS

Official Communication issued in International Patent Application No. PCT/JP2019/030144, dated Sep. 3, 2019.
(Continued)

*Primary Examiner* — Carson Gross
(74) *Attorney, Agent, or Firm* — Keating and Bennett, LLP

(57) ABSTRACT

An apparatus for heat treatment of a heat shrinkable film includes a steam generation apparatus that generates steam, a heated air generation apparatus that generates heated air not lower in temperature than steam generated in the steam generation apparatus, a mixed gas generator that generates mixed gas not lower in temperature than steam generated in the steam generation apparatus by mixing steam generated in the steam generation apparatus and heated air generated in the heated air generation apparatus, a reheating apparatus that generates superheated steam by reheating mixed gas generated in the mixed gas generator, and a supply portion that supplies superheated steam generated in the reheating apparatus to a heat treatment chamber.

9 Claims, 4 Drawing Sheets

(56) References Cited

U.S. PATENT DOCUMENTS

| | | | | |
|---|---|---|---|---|
| 2013/0224674 | A1 | 8/2013 | Malthouse et al. | |
| 2014/0041341 | A1 | 2/2014 | Koolhaas et al. | |
| 2016/0083134 | A1* | 3/2016 | Vissa | B29C 63/38 219/401 |
| 2017/0225818 | A1 | 8/2017 | Lue | |

FOREIGN PATENT DOCUMENTS

| | | | |
|---|---|---|---|
| JP | 2003-054520 | A | 2/2003 |
| JP | 2008-050041 | A | 3/2008 |
| JP | 2008-150063 | A | 7/2008 |
| JP | 2017-178372 | A | 10/2017 |
| WO | 2014/208155 | A1 | 12/2014 |

OTHER PUBLICATIONS

Official Communication issued in corresponding European Patent Application No. 19848349.7, dated Mar. 25, 2022.

* cited by examiner

APPARATUS AND METHOD FOR HEAT TREATMENT OF HEAT SHRINKABLE FILM

TECHNICAL FIELD

The present invention relates to an apparatus and a method for heat treatment of a heat shrinkable film (which may simply be referred to as a heat treatment apparatus and a heat treatment method below) that allow covering, by heating and shrinking the heat shrinkable film applied to an article, of a part or the entirety of the article with the shrunk heat shrinkable film.

BACKGROUND ART

A container such as a bottle or a cup where beverage, food, or a drug is accommodated has conventionally been wrapped with a heat shrinkable film. Wrapping with the heat shrinkable film can be done by applying a yet-to-be-shrunk heat shrinkable film to a container and heating and shrinking the heat shrinkable film (the heat shrinkable film and the container may collectively be referred to as a workpiece below). Heat treatment apparatuses allowing wrapping with such a heat shrinkable film are broadly categorized into three types below.

The heat treatment apparatus of the first type is referred to as a steam tunnel type, and for example, Japanese Patent Laying-Open No. 9-272514 (PTL 1) discloses a specific construction thereof. The heat treatment apparatus transfers a workpiece to pass through a tunnel filled with high-temperature steam with a transfer mechanism such as a conveyor so that the heat shrinkable film is shrunk to cover a container.

The heat treatment apparatus of this type is excellent in finishing of the shrunk heat shrinkable film (that is, few creases being produced), whereas a large number of water droplets are attached to the workpiece also after passage through the tunnel. Therefore, drying treatment should separately be performed in a subsequent process and the apparatus may increase in size and become complicated. When the container contains a hygroscopic material, moisture may enter the container through a gap therein and hence use of the apparatus tends to be avoided.

The heat treatment apparatus of the second type is referred to as a dry tunnel type, and for example, Japanese Patent Laying-Open No. 2003-54520 (PTL 2) discloses a specific construction thereof. The heat treatment apparatus transfers, with a transfer mechanism such as a conveyor, a workpiece to pass through a tunnel where convection is produced by sending dry high-temperature gas so that the heat shrinkable film is shrunk to cover a container.

The heat treatment apparatus of this type is free from attachment of water droplets to the workpiece during passage through the tunnel and does not require drying treatment. Therefore, the apparatus can be compact and simple, and in particular effective for a workpiece unsuitable for treatment in the heat treatment apparatus of the steam tunnel type. This apparatus, however, is significantly poorer in finishing of the shrunk heat shrinkable film (that is, creases being likely) than the heat treatment apparatus of the steam tunnel type.

The heat treatment apparatus of the third type is referred to as a superheated steam tunnel type, and for example, Japanese Patent Laying-Open No. 2008-150063 (PTL 3) discloses a specific construction thereof. The heat treatment apparatus generates high-temperature superheated steam by heating steam with a superheater and transfers a workpiece to pass through a tunnel filled with superheated steam, with a transfer mechanism such as a conveyor, so that the heat shrinkable film is shrunk to cover a container.

The heat treatment apparatus of this type is significantly smaller in amount of attachment of water droplets to the workpiece that has passed through the tunnel than the heat treatment apparatus of the steam tunnel type. Therefore, a drying process can be simplified, and in this regard, the apparatus can be compact and simple. The heat treatment apparatus is also advantageous in better finishing of the shrunk heat shrinkable film than the heat treatment apparatus of the dry tunnel type.

CITATION LIST

Patent Literature

PTL 1: Japanese Patent Laying-Open No. 9-272514
PTL 2: Japanese Patent Laying-Open No. 2003-54520
PTL 3: Japanese Patent Laying-Open No. 2008-150063

SUMMARY OF INVENTION

Technical Problem

As described above, the heat treatment apparatus of the superheated steam tunnel type can be compact and simple, and relatively satisfactory also in finishing of the shrunk heat shrinkable film. Therefore, in this regard, the heat treatment apparatus of the superheated steam tunnel type can be concluded as being superior to the heat treatment apparatuses of the steam tunnel type and the dry tunnel type.

The heat treatment apparatus of the superheated steam tunnel type, however, still suffers from attachment of water droplets to the workpiece after passage through the tunnel as described above, although an amount thereof is small. This problem is caused by a relatively high relative humidity of superheated steam introduced into the tunnel.

Specifically, the temperature of superheated steam around an exit of the tunnel tends to be affected by an external environment, and it is slightly lower than the temperature of superheated steam in a central portion of the tunnel. Accordingly, superheated steam is condensed around the exit of the tunnel, and condensed superheated steam is attached to the workpiece as water droplets. For example, when the temperature of superheated steam introduced into the tunnel is 150 [° C.] and the relative humidity thereof exceeds 12 [%], water droplets are attached to the workpiece after passage through the tunnel.

Therefore, in particular when the container contains a hygroscopic material, the heat treatment apparatus of the superheated steam tunnel type separately requires also drying treatment for removing produced water droplets. The drying treatment cannot completely be eliminated and improvement in this regard has further been demanded.

Therefore, the present invention was made in view of the problems described above, and an object thereof is to provide an apparatus and a method for heat treatment of a heat shrinkable film that achieve excellent finishing of a shrunk heat shrinkable film and allow the apparatus to be compact and simple.

Solution to Problem

An apparatus for heat treatment of a heat shrinkable film based on the present invention allows, by heating and shrinking the heat shrinkable film with superheated steam, covering of a part or the entirety of an article with the shrunk heat shrinkable film. The apparatus for heat treatment includes a heat treatment chamber into which the article to which a yet-to-be-shrunk heat shrinkable film is applied is loaded and a superheated steam generation and supply apparatus that generates superheated steam and supplies superheated steam to the heat treatment chamber. The superheated steam generation and supply apparatus includes a steam generation apparatus that generates steam, a heated air generation apparatus that generates heated air not lower in temperature than steam generated in the steam generation apparatus, a mixed gas generator that generates mixed gas not lower in temperature than steam generated in the steam generation apparatus by mixing steam generated in the steam generation apparatus and heated air generated in the heated air generation apparatus, a reheating apparatus that generates superheated steam by reheating mixed gas generated in the mixed gas generator, and a supply portion that supplies superheated steam generated in the reheating apparatus to the heat treatment chamber.

In the apparatus for heat treatment of the heat shrinkable film based on the present invention, preferably, a temperature of superheated steam generated in the reheating apparatus is not lower than 150 [° C.] and not higher than 300 [° C.] and a relative humidity of superheated steam generated in the reheating apparatus is not lower than 0.04 [%] and not higher than 3.4 [%].

In the apparatus for heat treatment of the heat shrinkable film based on the present invention, preferably, the mixed gas generator mixes steam generated in the steam generation apparatus and heated air generated in the heated air generation apparatus while both of steam and heated air are flowing.

In the apparatus for heat treatment of the heat shrinkable film based on the present invention, preferably, the mixed gas generator mixes steam generated in the steam generation apparatus and heated air generated in the heated air generation apparatus while steam and heated air are flowing in an identical direction.

In the apparatus for heat treatment of the heat shrinkable film based on the present invention, the mixed gas generator may include a double-pipe structure portion including an inner pipe and an outer pipe and a mixing portion located downstream from the double-pipe structure portion. In that case, preferably, steam generated in the steam generation apparatus and heated air generated in the heated air generation apparatus are mixed in the mixing portion by flow through the inner pipe, of one of steam generated in the steam generation apparatus and heated air generated in the heated air generation apparatus and flow through the outer pipe, of the other of steam generated in the steam generation apparatus and heated air generated in the heated air generation apparatus.

In the apparatus for heat treatment of the heat shrinkable film based on the present invention, preferably, the steam generation apparatus generates saturated steam.

The apparatus for heat treatment of the heat shrinkable film based on the present invention may further include a transfer path along which the article covered with the heat shrinkable film is transferred. In that case, preferably, the transfer path is provided to pass through the heat treatment chamber.

The apparatus for heat treatment of the heat shrinkable film based on the present invention may further include a pre-heat treatment chamber located on an upstream side of the transfer path when viewed from the heat treatment chamber, where the article to which the yet-to-be-shrunk heat shrinkable film is applied is heated in advance before the article is loaded into the heat treatment chamber.

A method of heat treatment of a heat shrinkable film based on the present invention includes generating, by mixing steam and heated air not lower in temperature than steam, mixed gas not lower in temperature than steam, generating superheated steam by reheating mixed gas, and covering, by heating a yet-to-be-shrunk heat shrinkable film applied to an article with superheated steam, a part or the entirety of the article with a shrunk heat shrinkable film.

Advantageous Effects of Invention

According to the present invention, an apparatus and a method for heat treatment of a heat shrinkable film that achieve excellent finishing of a shrunk heat shrinkable film and allow the apparatus to be compact and simple can be provided.

DESCRIPTION OF EMBODIMENTS

Figure 1:
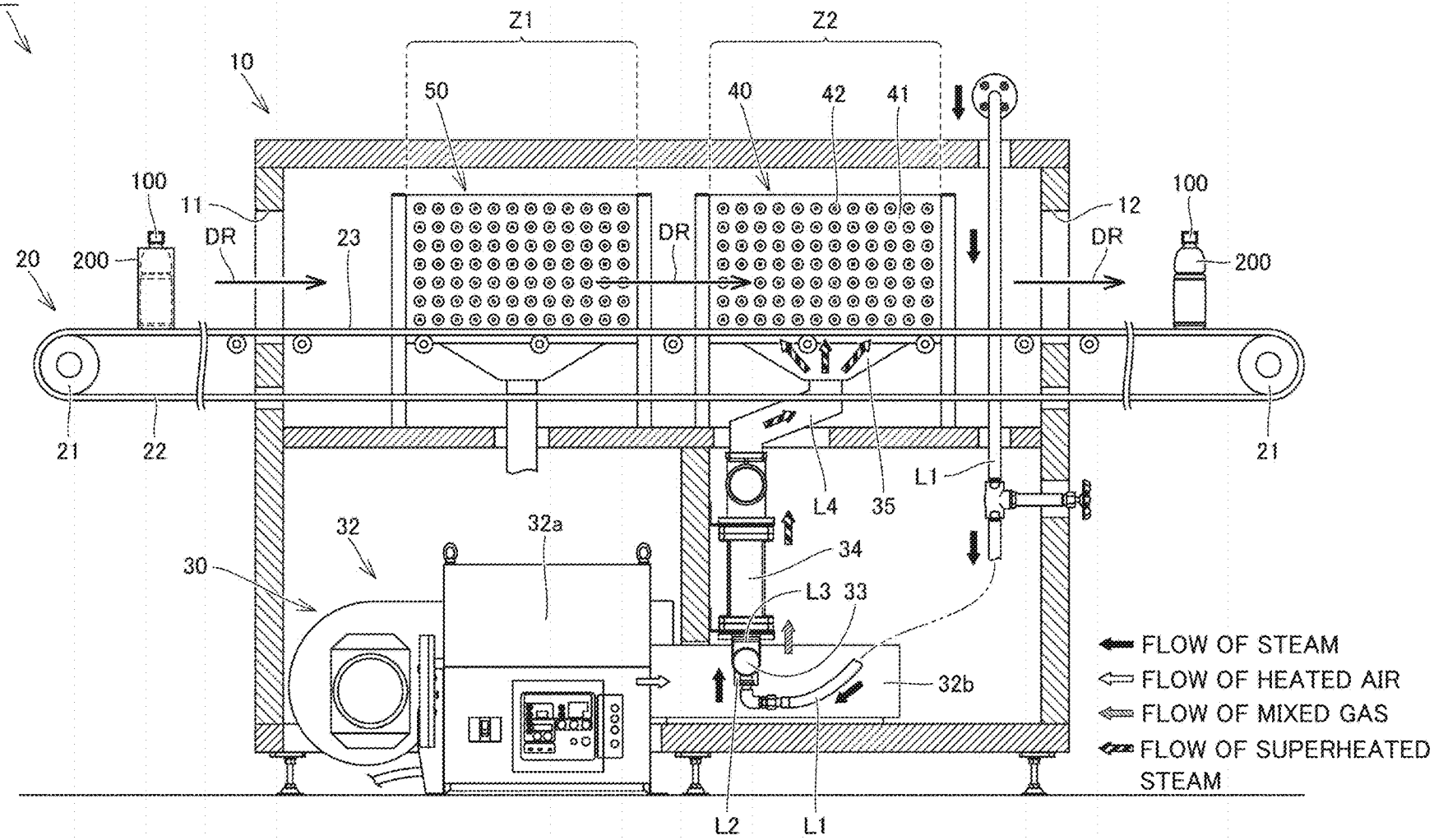
FIG. 1 is a schematic lateral cross-sectional view of a heat treatment apparatus according to an embodiment.

An embodiment of the present invention will be described below in detail with reference to the drawings. In the embodiment shown below, the same or common elements in the drawings have the same reference characters allotted and description thereof will not be repeated.

An embodiment shown below illustrates application of the present invention to an apparatus and a method for heat treatment of a heat shrinkable film by heating and shrinking the heat shrinkable film applied to a PET bottle, and in particular illustrates application of the present invention to serial type apparatus and method for heat treatment of a heat shrinkable film that allow a serial process of a plurality of workpieces. A heat shrinkable film with which a PET bottle is covered when it is shrunk refers to a label on which a trade name or contents is/are printed. Though a material for the heat shrinkable film is not particularly limited so long as it is heat shrinkable, typical examples of the material include a polystyrene resin and a polyethylene terephthalate resin.

Figure 2:
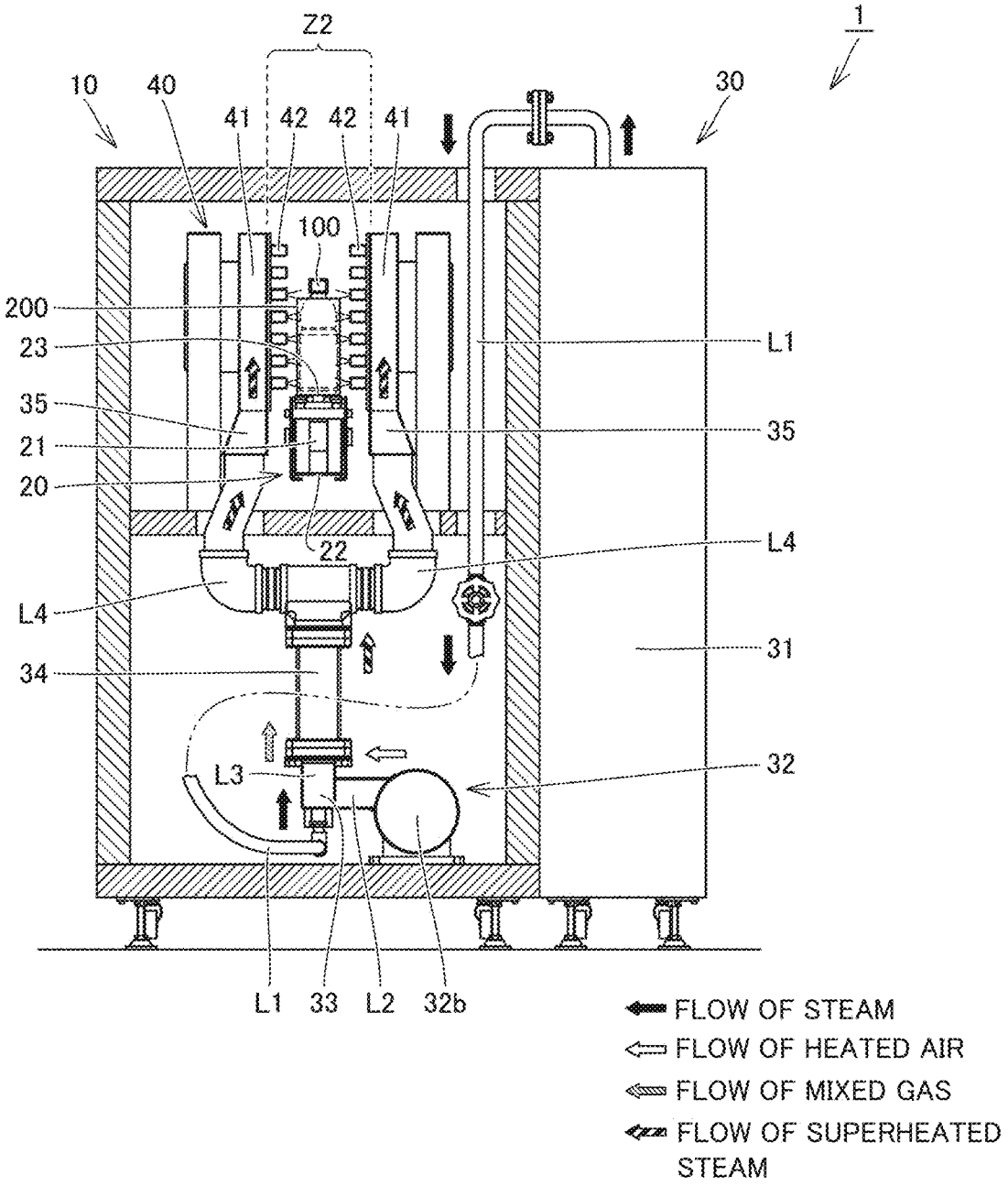
FIG. 2 is a schematic vertical cross-sectional view of the heat treatment apparatus shown in FIG. 1.

FIGS. 1 and 2 are a schematic lateral cross-sectional view and a schematic vertical cross-sectional view of a heat treatment apparatus according to an embodiment, respectively. A schematic construction of a heat treatment apparatus 1 according to the present embodiment will initially be described with reference to FIGS. 1 and 2.

As shown in FIGS. 1 and 2, heat treatment apparatus 1 has an outer geometry substantially in a shape of a parallelepiped as a whole, and it mainly includes a casing 10, a transfer mechanism 20, a superheated steam generation and supply apparatus 30, a heat treatment chamber 40, and a pre-heat treatment chamber 50. Casing 10 forms a skeleton of heat treatment apparatus 1, and heat treatment apparatus 1 is formed by casing 10 provided with transfer mechanism 20, superheated steam generation and supply apparatus 30, heat treatment chamber 40, and pre-heat treatment chamber 50 described above.

Casing 10 includes an entrance port 11 in its one sidewall and an exit port 12 in the other sidewall. Entrance port 11 and exit port 12 are provided as openings for loading a PET bottle 100 to which a heat shrinkable film 200 as a workpiece is applied into and out of casing 10. Entrance port 11 and exit port 12 are arranged as being opposed to each other, and a curtain or a shutter which is not shown may be provided as necessary.

Transfer mechanism 20 includes what is called a top chain conveyor, and is provided to extend from entrance port 11 to exit port 12 described above. The conveyor is not limited to the top chain conveyor but may be a belt conveyor. Transfer mechanism 20 includes a plurality of rollers 21 and an endless chain 22 placed around the plurality of rollers 21. The plurality of rollers 21 include a drive roller and a driven roller. As the drive roller of the rollers is driven by a drive mechanism including a not-shown motor, chain 22 is movable.

One end of transfer mechanism 20 in a transfer direction is drawn to the outside of casing 10 from entrance port 11, and a portion drawn out of entrance port 11 defines a workpiece introduction portion. The other end of transfer mechanism 20 in the transfer direction is drawn to the outside of casing 10 from exit port 12, and a portion drawn out of exit port 12 defines a workpiece exit portion.

Chain 22 makes up a transfer path 23 along which workpieces are transferred, and transfers workpieces placed thereon at the introduction portion described above to the exit portion described above. The workpieces thus move through heat treatment apparatus 1 along a direction shown with an arrow DR in FIG. 1 in the order of the introduction portion, entrance port 11, pre-heat treatment chamber 50 which will be described in detail later, heat treatment chamber 40 which will be described in detail later, exit port 12, and the exit portion. By sequentially introducing a plurality of workpieces at the introduction portion, the plurality of workpieces can successively be processed in heat treatment apparatus 1.

Superheated steam generation and supply apparatus 30 generates superheated steam for heating and shrinking a heat shrinkable film and supplies superheated steam to heat treatment chamber 40. Superheated steam generation and supply apparatus 30 mainly includes a steam generation apparatus 31 (see FIG. 2), a heated air generation apparatus 32, a mixed gas generator 33, a reheating apparatus 34, a supply portion 35, and pipe lines L1 to L4 that connect these components to one another.

Steam generation apparatus 31 generates steam by heating water and it includes, for example, a boiler. Though steam generation apparatus 31 preferably generates saturated steam, it may generate heated air containing steam noticeably high in relative humidity. Steam generation apparatus 31 is annexed to the outside of a rear wall of casing 10.

Heated air generation apparatus 32 generates dry heated air by taking in air and heating air, and it includes, for example, a hot air generator. Heated air generation apparatus 32 includes an apparatus main body 32*a* that generates heated air and a tank 32*b* where generated heated air is temporarily stored in a compressed state, and is provided at a prescribed position in casing 10.

Mixed gas generator 33 is connected to steam generation apparatus 31 through pipe line L1 and connected to heated air generation apparatus 32 through pipe line L2. Mixed gas generator 33 mixes steam generated in steam generation apparatus 31 and heated air generated in heated air generation apparatus 32. Mixed gas generator 33 is provided at a prescribed position in casing 10 and formed from a portion of connection between pipe lines L1 and L2 and pipe line L3 which will be described later. A detailed structure of the mixed gas generator will be described later.

Reheating apparatus 34 is connected to mixed gas generator 33 through pipe line L3. Reheating apparatus 34 generates superheated steam that satisfies prescribed temperature condition and humidity condition which will be described later by reheating mixed gas generated in mixed gas generator 33, and it includes, for example, a superheater. Reheating apparatus 34 is provided at a prescribed position in casing 10. A detailed structure of the reheating apparatus will be described later.

Supply portion 35 is connected to reheating apparatus 34 through pipe line L4 and connected to a pair of sidewalls 41 that forms heat treatment chamber 40. Supply portion 35 serves to supply superheated steam generated in reheating apparatus 34 to heat treatment chamber 40, and it includes, for example, a duct. In the present embodiment, supply portion 35 includes a branched pipe structure corresponding to the pair of sidewalls 41 described above, and downstream ends thereof are connected to the pair of sidewalls 41. Supply portion 35 is provided at a prescribed position in casing 10.

In the present embodiment, steam generation apparatus 31 is annexed to the outside of casing 10 as described above, because steam generation apparatus 31 is relatively large. Steam generation apparatus 31, however, may be provided at a location distant from casing 10 and may be connected through a pipe line. When steam generation apparatus 31 is compact, it may naturally be provided in casing 10.

In the present embodiment, though heated air generation apparatus 32, mixed gas generator 33, and reheating apparatus 34 are provided in the casing as described above, at least one or all of them may be annexed to the outside of casing 10 similarly to steam generation apparatus 31, or may be provided at a location distant from casing 10 and connected through a pipe line.

Heat treatment chamber 40 is provided in casing 10 and defined by the pair of sidewalls 41 arranged as being opposed to each other. More specifically, heat treatment chamber 40 is formed like a tunnel by arrangement of the pair of sidewalls 41 as being opposed to each other to sandwich transfer path 23 described above, so that transfer path 23 passes through heat treatment chamber 40. The pair of sidewalls 41 is provided with a plurality of nozzles 42, and each of the plurality of nozzles 42 faces transfer path 23.

The plurality of nozzles 42 are provided, for example, as being distributed in rows and columns as illustrated, and each of them is connected to supply portion 35 described above. Specifically, a flow path leading to each of the plurality of nozzles 42 is provided in the inside of each of the pair of sidewalls 41 and the flow path is connected to supply portion 35 described above. The plurality of nozzles 42 thus inject superheated steam generated in reheating apparatus 34 into a space in the vicinity of transfer path 23.

Pre-heat treatment chamber 50 is located on an upstream side of transfer path 23 when viewed from heat treatment chamber 40 described above, and substantially similar in structure to heat treatment chamber 40. Pre-heat treatment chamber 50 serves to heat a workpiece in advance prior to introduction of the workpiece into heat treatment chamber 40, and for example, dry heated air can be injected toward the workpiece in the chamber. For example, heated air generated in heated air generation apparatus 32 described above can be used as dry heated air.

A region in transfer path 23 where pre-heat treatment chamber 50 is provided functions as a preheating zone Z1. In preheating zone Z1, heat shrinkable film 200 applied to PET bottle 100 is heated to a temperature, for example, approximately not lower than 60 [° C.] and not higher than 120 [° C.]. Heat shrinkable film 200 is thus softened. In preheating zone Z1, the space inside tunnel-shaped pre-heat treatment chamber 50 is filled exclusively with high-temperature heated air containing substantially no steam, and hence no water droplet is attached to a workpiece in preheating zone Z1.

A region in transfer path 23 where heat treatment chamber 40 is provided functions as a main heating zone Z2. In main heating zone Z2, heat shrinkable film 200 applied to PET bottle 100 and softened by being heated in preheating zone Z1 is heated further to a temperature approximately not lower than 150 [° C.] and not higher than 300 [° C.].

In main heating zone Z2, as described above, the space inside tunnel-shaped heat treatment chamber 40 is filled exclusively with superheated steam that satisfies the prescribed temperature condition and humidity condition which will be described later. In general, during a period until the temperature of superheated steam lowers to a saturation temperature, superheated steam is not condensed but a part of enthalpy thereof merely decreases. Superheated steam is suitable for heating of the heat shrinkable film in its less likeliness of attachment of water droplets to a workpiece.

In actual, however, when a relative humidity of superheated steam is relatively high, steam is condensed by being affected by a surrounding environment. Therefore, in the conventional heat treatment apparatus of the superheated steam tunnel type described above, water droplets are consequently attached to workpieces that have passed through the tunnel, although an amount thereof is small.

In this connection, in heat treatment apparatus 1 according to the present embodiment, heat treatment chamber 40 is filled with superheated steam that satisfies the prescribed temperature condition and humidity condition which will be described later. Therefore, water droplets are basically not attached to workpieces in main heating zone Z2.

Figure 3:
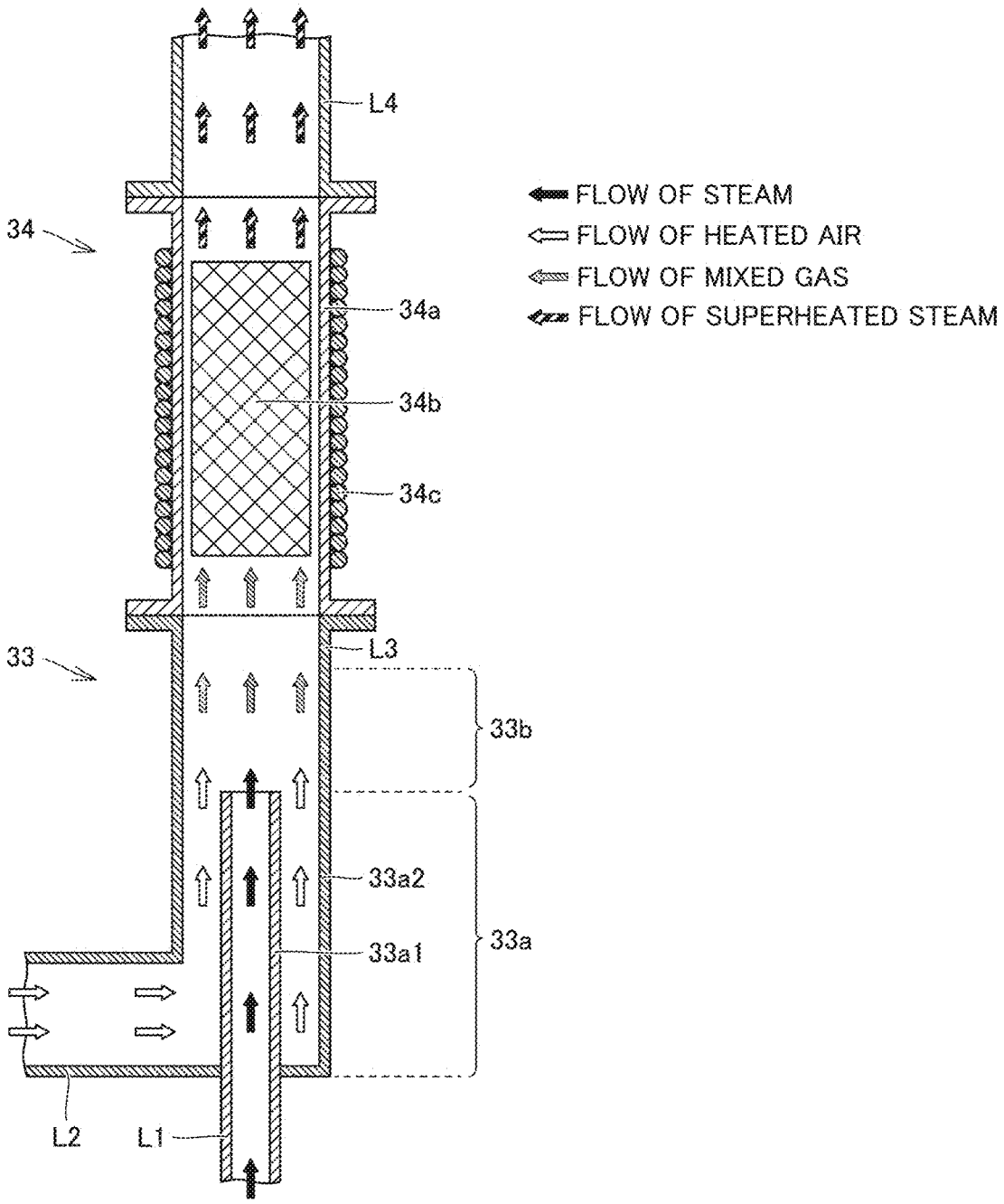
FIG. 3 is a schematic cross-sectional view of the vicinity of a mixed gas generator and a reheating apparatus shown in FIGS. 1 and 2.

FIG. 3 is a schematic cross-sectional view of the vicinity of the mixed gas generator and the reheating apparatus shown in FIGS. 1 and 2. A construction of the vicinity of mixed gas generator 33 and reheating apparatus 34 of heat treatment apparatus 1 according to the present embodiment will now be described with reference to FIG. 3.

As shown in FIG. 3, mixed gas generator 33 includes a double-pipe structure portion 33*a* including an inner pipe 33*a*1 and an outer pipe 33*a*2 and a mixing portion 33*b* made only from outer pipe 33*a*2 located downstream from double-pipe structure portion 33*a*. Double-pipe structure portion 33 includes coaxially arranged inner pipe 33*a*1 and outer pipe 33*a*2.

Inner pipe 33*a*1 is formed from a part of pipe line L1 described above and outer pipe 33*a*2 is formed from a part of pipe line L2 described above. Therefore, steam generated in steam generation apparatus 31 is sent into mixing portion 33*b* through inner pipe 33*a*1, and dry heated air generated in heated air generation apparatus 32 is sent into mixing portion 33*b* through outer pipe 33*a*2. In mixing portion 33*b*, steam and dry heated air are thus mixed while they are flowing, and mixed gas thereof is thus generated.

Reheating apparatus 34 includes a tubular housing 34*a* provided with an inlet and an outlet, a heat generator 34*b* accommodated in housing 34*a*, and a coil 34*c* wound around the outside of housing 34*a* to surround heat generator 34*b*, and the reheating apparatus is arranged downstream from mixing portion 33*b* of mixed gas generator 33. Housing 34*a* has an end on the inlet side connected to outer pipe 33*a*2 that forms a part of pipe line L3 and has an end on the outlet side connected to pipe line L4.

Reheating apparatus 34 is an electromagnetic induction heating superheater. Reheating apparatus 34 heats gas that flows through the inside of housing 34*a* to be in thermal contact with heat generator 34*b* by generating, by applying a current to coil 34*c*, an eddy current in heat generator 34*b* constructed, for example, of a plurality of layered thin stainless steel plates each press-formed into a prescribed shape.

Mixed gas generated by mixing of steam and dry heated air in mixing portion 33*b* described above is introduced into reheating apparatus 34 through pipe line L3. Receiving heat generated by heat generator 34*b*, mixed gas is thus reheated to increase in temperature, and mixed gas becomes superheated steam that satisfies the prescribed temperature condition and humidity condition which will be described later, and is fed to pipe line L4.

By mixing steam and dry heated air in mixed gas generator 33 made from double-pipe structure portion 33*a* described above and mixing portion 33*b* located downstream therefrom, steam and dry heated air can sufficiently be mixed in a short period of time. This is because steam and dry heated air are mixed in mixing portion 33*b* while they are flowing. Thus, not only mixed gas generator 33 can be compact but also superheated steam that satisfies the prescribed temperature condition and humidity condition which will be described later can reliably be generated in reheating apparatus 34.

With attention being paid only to a point of view of mixing of steam and dry heated air, mixed gas generator 33 does not necessarily have to include double-pipe structure portion 33*a* as described above, and a flow path should only be constructed to allow mixing of steam and dry heated air. In that case, by merging a pipe through which steam flows and a pipe through which dry heated air flows, steam and dry heated air are mixed while they are flowing and hence they can more reliably be mixed. Furthermore, by setting directions of flow to an identical direction, flow loss in steam and dry heated air that flow can be suppressed.

In the present embodiment, though inner pipe 33*a*1 is formed from pipe line L1 and outer pipe 33*a*2 is formed from pipe line L2, inner pipe 33*a*1 may be formed from pipe line L2 and outer pipe 33*a*2 may be formed from pipe line L1. In that case, dry heated air generated in heated air generation apparatus 32 is sent through inner pipe 33*a*1 into mixing portion 33*b* and steam generated in steam generation apparatus 31 is sent through outer pipe 33*a*2 into mixing portion 33*b*.

Figure 4:
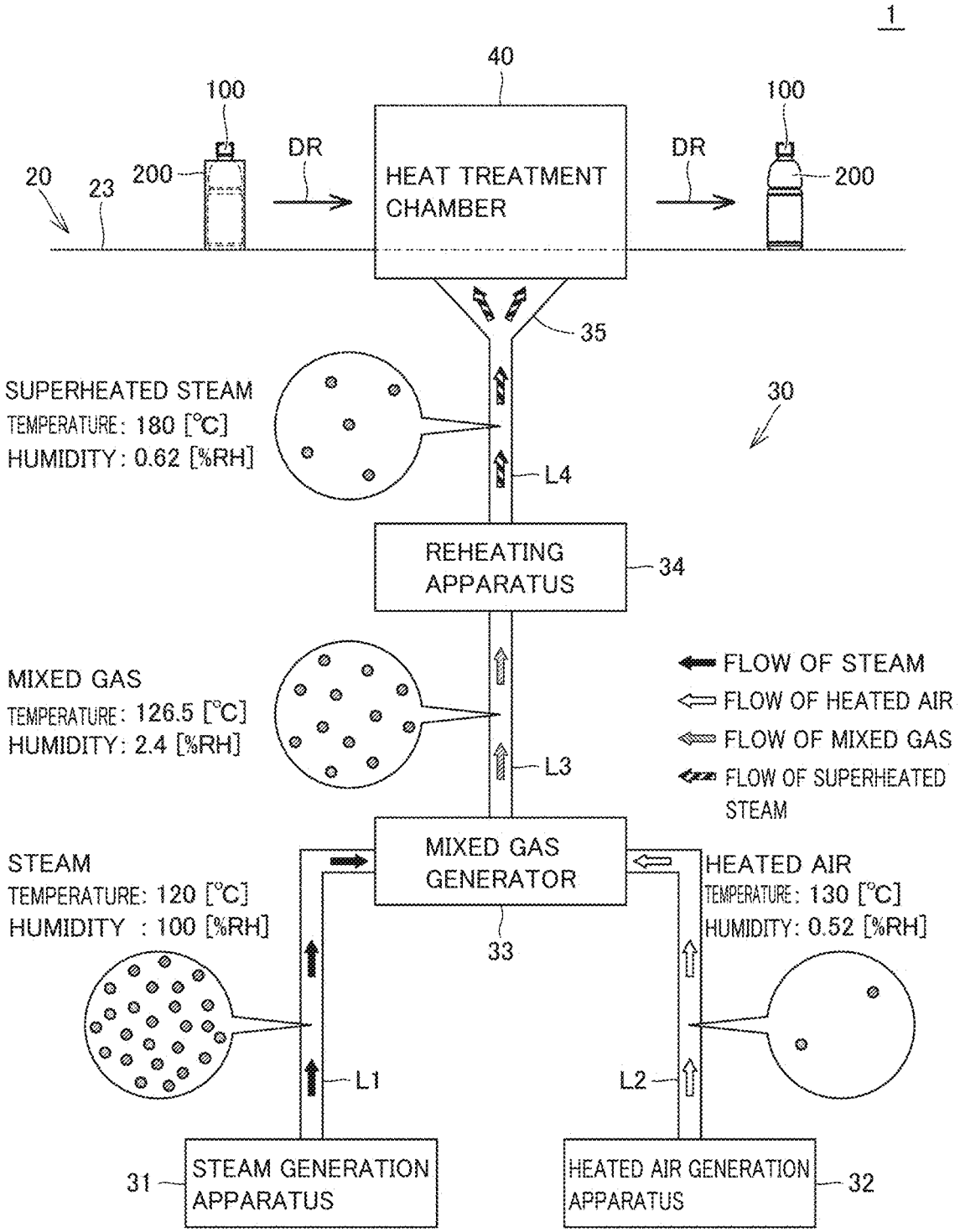
FIG. 4 is a diagram schematically showing a method of heat treatment of a heat shrinkable film in the heat treatment apparatus shown in FIG. 1.

FIG. 4 is a diagram schematically showing a method of heat treatment of a heat shrinkable film in the heat treatment apparatus according to the present embodiment described above. The heat treatment method in heat treatment apparatus 1 according to the present embodiment (that is, the method of heat treatment of a heat shrinkable film according to the present embodiment) will be described in detail below with reference to FIG. 4.

Referring to FIG. 4, in summary, the heat treatment method in heat treatment apparatus 1 includes first to third steps below.

In the first step, steam generated in steam generation apparatus 31 and dry heated air generated in heated air generation apparatus 32 not lower in temperature than steam are mixed in mixed gas generator 33 to generate mixed gas not lower in temperature than steam.

In the second step, mixed gas generated in mixed gas generator 33 is reheated in reheating apparatus 34 to generate superheated steam.

In the third step, superheated steam generated in reheating apparatus 34 is injected to yet-to-be-shrunk heat shrinkable film 200 applied to PET bottle 100 to heat and shrink heat shrinkable film 200, so that a part of PET bottle 100 is covered with shrunk heat shrinkable film 200.

Superheated steam generated in the first and second steps described above is generated by reheating mixed gas generated by mixing of heated air containing saturated steam or steam noticeably high in relative humidity and dry heated air (that is, heated air containing substantially no steam) not lower in temperature than steam, and in this regard, this superheated steam is clearly distinguished from superheated steam obtained simply by heating heated air containing saturated steam or steam noticeably high in relative humidity as it is.

More specifically, the temperature of superheated steam generated in the first and second steps described above is approximately not lower than 150 [° C.] and not higher than 300 [° C.] and the relative humidity thereof is approximately not lower than 0.04 [%] and not higher than 3.4 [%]. Superheated steam generated in the first and second steps is noticeably lower in relative humidity to such an extent as not being condensed even by lowering in temperature around the exit (that is, around exit port 12) of the tunnel than superheated steam obtained simply by heating heated air containing saturated steam or steam noticeably high in relative humidity as it is. As described previously, when the temperature of superheated steam introduced into the tunnel is 150 [° C.] and the relative humidity thereof exceeds 12 [%], water droplets are attached to a workpiece after it passes through the tunnel. As compared with this superheated steam, superheated steam generated in the present embodiment is clearly noticeably lower in relative humidity.

When the temperature of steam generated in steam generation apparatus 31 is not lower than 100 [° C.] and not higher than 160 [° C.], a vapor content of steam is not smaller than 10 [kg/h] and not larger than 30 [kg/h], and a vapor pressure of steam is not lower than 0.1 [MPa] and not higher than 0.5 [MPa], and when the temperature of heated air generated in heated air generation apparatus 32 is not lower than 100 [° C.] and not higher than 250 [° C.] on the premise that it is higher than the temperature of steam and a ratio of mixing based on a volume of steam and heated air is from 1:2 to 1:5, superheated steam noticeably low in relative humidity described above can be obtained by heating mixed gas in reheating apparatus 34.

By way of example, as shown in FIG. 4, when the temperature of steam generated in steam generation apparatus 31 is 120 [° C.] and the relative humidity thereof is 100 [%], when the temperature of heated air generated in heated air generation apparatus 32 is 130 [° C.] and the relative humidity thereof is 0.52 [%], and when they are mixed at a ratio of mixing of 1:5, the temperature of generated mixed gas is 126.5 [° C.] and the relative humidity thereof is 2.4 [%]. By further heating mixed gas to 180 [° C.] in reheating apparatus 34, the relative humidity of obtained superheated steam is 0.62 [%].

As described above, by applying the heat treatment method in heat treatment apparatus 1 described above to heat and shrink heat shrinkable film 200 applied to PET bottle 100, a workpiece is exposed to an atmosphere of superheated steam noticeably low in relative humidity and hence water droplets are not attached to the workpiece as it passes through the tunnel. Therefore, consequently, drying treatment does not have to separately be performed and the apparatus can be more compact and simpler than the conventional heat treatment apparatus of the superheated steam tunnel type described above.

In addition, in application of the heat treatment method in heat treatment apparatus 1 described above, though the workpiece is exposed to the atmosphere of superheated steam noticeably low in relative humidity, finishing of the shrunk heat shrinkable film is better owing to more moisture in superheated steam than in dry high-temperature gas (that is, heated air containing substantially no steam) which is the atmosphere to which the workpiece is exposed in the conventional heat treatment apparatus of the dry tunnel type described above.

Therefore, with heat treatment apparatus 1 according to the present embodiment, the apparatus for heat treatment of the heat shrinkable film that can achieve excellent finishing of the shrunk heat shrinkable film and can be compact and simple can be provided. Therefore, not only a degree of freedom in providing the heat treatment apparatus is enhanced but also a high-performance heat treatment apparatus can be provided more inexpensively.

The reason why heated air to be mixed with steam should be not lower in temperature than steam in the first step described above is that, when heated air lower in temperature than steam is mixed, some of steam is condensed at the time of mixing, and when some of steam is condensed, it becomes difficult to efficiently generate superheated steam noticeably low in relative humidity.

Heat treatment chamber 40 should constantly be filled with superheated steam that satisfies the prescribed temperature condition and humidity condition described above. This condition can be satisfied by appropriately adjusting a size of entrance port 11 and exit port 12 of casing 10 (more strictly, a size of an entrance port and an exit port of heat treatment chamber 40) or a speed of transfer of a workpiece. From this point of view, by way of example, entrance port 11 and exit port 12 of casing 10 may be set to a vertical dimension of 300 [mm] and a lateral dimension of 200 [mm] and the speed of transfer of a workpiece may be not lower than 5 [m/min.] and not higher than 70 [m/min.].

By way of example, in this case, heat treatment chamber 40 may be set to a vertical dimension of 350 [mm], a lateral dimension not smaller than 110 [mm] and not larger than 200 [mm], and a width dimension (that is, a length in the transfer direction) of 500 [mm], and by way of example, a flow rate of superheated steam may be not lower than 6.3 [$m^3$/min.] and not higher than 21.5 [$m^3$/min.].

Though an example in which the pre-heat treatment chamber is provided in the heat treatment apparatus in addition to the heat treatment chamber is illustrated and described in the embodiment above, the pre-heat treatment chamber is not necessarily an essential feature and does not have to be provided in some cases. On the other hand, in order to further improve finishing of the shrunk heat shrinkable film as necessary, a post-heat treatment chamber may be provided in the heat treatment apparatus in addition to the heat treatment chamber.

The pre-heat treatment chamber or the post-heat treatment chamber may be in a shape of a tunnel such that dry heated air is injected to a workpiece, or may include a far-infrared heater, a near-infrared heater, or a halogen lamp.

Though an example in which an electromagnetic induction heating superheater is employed as the reheating apparatus is illustrated in the embodiment described above, superheaters of various heating types can also be employed instead.

Though an example in which a steam generation apparatus is adopted as an apparatus for generating steam is illustrated in the embodiment described above, a superheated steam generation apparatus that generates superheated steam may be adopted instead. In this case, mixed gas should only be generated by mixing heated air generated in the heated air generation apparatus with superheated steam generated in the superheated steam generation apparatus and controlled to desired temperature and relative humidity by being reheated in the reheating apparatus.

Though application of the present invention to the serial type apparatus and method for heat treatment of the heat shrinkable film that allow a serial process of a plurality of workpieces is illustrated and described in the embodiment above, the present invention is also applicable to what is called a batch type apparatus and method for heat treatment of a heat shrinkable film.

Furthermore, though application of the present invention to the apparatus and the method for heat treatment of the heat shrinkable film with which the heat shrinkable film applied to a PET bottle is heated and shrunk is illustrated and described in the embodiment above, the present invention is applicable to any apparatus and method for heat treatment of a heat shrinkable film with which the heat shrinkable film is heated and shrunk.

The embodiment disclosed herein is thus illustrative and non-restrictive in every respect. The technical scope of the present invention is defined by the terms of the claims and is intended to include any modifications within the scope and meaning equivalent to the terms of the claims.

REFERENCE SIGNS LIST

1 heat treatment apparatus; 10 casing; 11 entrance port; 12 exit port; 20 transfer mechanism; 21 roller; 22 chain; 23 transfer path; 30 superheated steam generation and supply apparatus; 31 steam generation apparatus; 32 heated air generation apparatus; 32*a* apparatus main body; 32*b* tank; 33 mixed gas generator; 33*a* double-pipe structure portion; 33*a*1 inner pipe; 33*a*2 outer pipe; 33*b* mixing portion; 34 reheating apparatus; 34*a* housing; 34*b* heat generator; 34*c* coil; 35 supply portion; 40 heat treatment chamber; 41 sidewall; 42 nozzle; 50 pre-heat treatment chamber; 100 PET bottle; 200 heat shrinkable film; L1 to L4 pipe line; Z1 preheating zone; Z2 main heating zone

The invention claimed is:

1. An apparatus for heat treatment of a heat shrinkable film that allows, by heating and shrinking the heat shrinkable film with superheated steam, covering of a part or entirety of an article with the shrunk heat shrinkable film, the apparatus for heat treatment comprising:

a heat treatment chamber into which the article to which a yet-to-be-shrunk heat shrinkable film is applied is loaded; and a superheated steam generation and supply apparatus that generates superheated steam and supplies superheated steam to the heat treatment chamber, the superheated steam generation and supply apparatus including a steam generation apparatus that generates steam, a heated air generation apparatus that generates heated air not lower in temperature than steam generated in the steam generation apparatus, a mixed gas generator that generates mixed gas not lower in temperature than steam generated in the steam generation apparatus by mixing steam generated in the steam generation apparatus and heated air generated in the heated air generation apparatus, a reheating apparatus that generates superheated steam by reheating mixed gas generated in the mixed gas generator, and a supply portion that supplies the superheated steam generated in the reheating apparatus to the heat treatment chamber.

2. The apparatus for heat treatment of the heat shrinkable film according to claim 1, wherein a temperature of superheated steam generated in the reheating apparatus is not lower than 150 [° C.] and not higher than 300 [° C.], and a relative humidity of superheated steam generated in the reheating apparatus is not lower than 0.04 [%] and not higher than 3.4 [%].

3. The apparatus for heat treatment of the heat shrinkable film according to claim 1, wherein the mixed gas generator mixes steam generated in the steam generation apparatus and heated air generated in the heated air generation apparatus while both of steam and heated air are flowing.

4. The apparatus for heat treatment of the heat shrinkable film according to claim 3, wherein the mixed gas generator mixes steam generated in the steam generation apparatus and heated air generated in the heated air generation apparatus while steam and heated air are flowing in an identical direction.

5. The apparatus for heat treatment of the heat shrinkable film according to claim 4, wherein the mixed gas generator includes a double-pipe structure portion including an inner pipe and an outer pipe and a mixing portion located downstream from the double-pipe structure portion, and steam generated in the steam generation apparatus and heated air generated in the heated air generation apparatus are mixed in the mixing portion by flow through the inner pipe, of one of steam generated in the steam generation apparatus and heated air generated in the heated air generation apparatus and flow through the outer pipe, of the other of steam generated in the steam generation apparatus and heated air generated in the heated air generation apparatus.

6. The apparatus for heat treatment of the heat shrinkable film according to claim 1, wherein the steam generation apparatus generates saturated steam.

7. The apparatus for heat treatment of the heat shrinkable film according to claim 1, further comprising a transfer path along which the article covered with the heat shrinkable film is transferred, wherein the transfer path is provided to pass through the heat treatment chamber.

8. The apparatus for heat treatment of the heat shrinkable film according to claim 7, further comprising a pre-heat treatment chamber located on an upstream side of the transfer path when viewed from the heat treatment chamber, where the article to which the yet-to-be-shrunk heat shrinkable film is applied is heated in advance before the article is loaded into the heat treatment chamber.

9. A method of heat treatment of a heat shrinkable film comprising:

generating, by mixing steam and heated air not lower in temperature than steam, mixed gas not lower in temperature than steam;

generating superheated steam by reheating the mixed gas; and covering, by heating a yet-to-be-shrunk heat shrinkable film applied to an article with the superheated steam, a part or entirety of the article with the shrunk heat shrinkable film.

* * * * *